United States Patent [19]

Roberts et al.

[11] Patent Number: 4,790,121

[45] Date of Patent: Dec. 13, 1988

[54] APPARATUS FOR FEEDING AND SECURING SANDING CLOTH WHEN SANDING TUBULAR OBJECTS

[76] Inventors: Devon Roberts; Rustin Roberts, both of 250 Athania Parkway, Metairie, La. 70001

[21] Appl. No.: 80,954

[22] Filed: Aug. 3, 1987

[51] Int. Cl.[4] ..... B24D 15/04

[52] U.S. Cl. ..... 51/360; 51/205 R; 51/392; 51/386

[58] Field of Search ..... 51/205 R, 241 S, 244, 51/331, 354, 358, 359, 360, 361, 370, 371, 372, 382, 386, 391, 392, 393; 15/104.03

[56] References Cited

U.S. PATENT DOCUMENTS

| | | | |
|---|---|---|---|
| 2,398,711 | 4/1946 | Lambert | 51/354 |
| 2,618,915 | 11/1952 | Johnson | 51/360 X |
| 2,922,218 | 1/1960 | Lewis | 51/352 X |
| 3,114,352 | 12/1963 | Mathisen | 51/391 X |
| 4,279,103 | 7/1981 | Rodarte | 51/391 X |
| 4,333,214 | 6/1982 | Neumann et al. | 51/205 R X |

*Primary Examiner*—Robert P. Olszewski

*Attorney, Agent, or Firm*—Pravel, Gambrell, Hewitt, Kimball & Krieger

[57] ABSTRACT

An apparatus for continuously feeding and securing an abrasive material such as sanding cloth, the apparatus including a pair of body portions secured on their first end adjacent one another and secured on their second ends in a spaced-apart position for defining a V-shaped space therebetween. There is further included a cushioned layer secured to the inner face of each body portion forming the V-shape, so that a continuous length of sand cloth may be positioned within the V-shaped set around a pin member inserted at the first ends of the body portion and each end of the sand cloth secured on the opposite face of each body portion during use. The apparatus further includes a handle member engaged to a bracket securing the second end portions in the spaced apart relation, so that when a section of pipe or the like is positioned against the surfaces of the sanding cloth, the apparatus may be rotated with the use of the handle member for abrading the surface of the section of pipe through rotation of the apparatus while the pipe is maintained stationary.

12 Claims, 2 Drawing Sheets

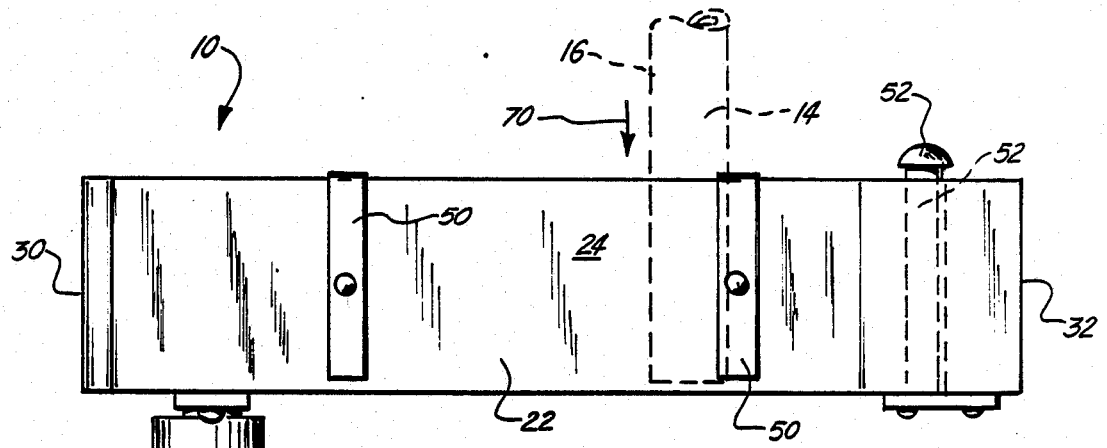
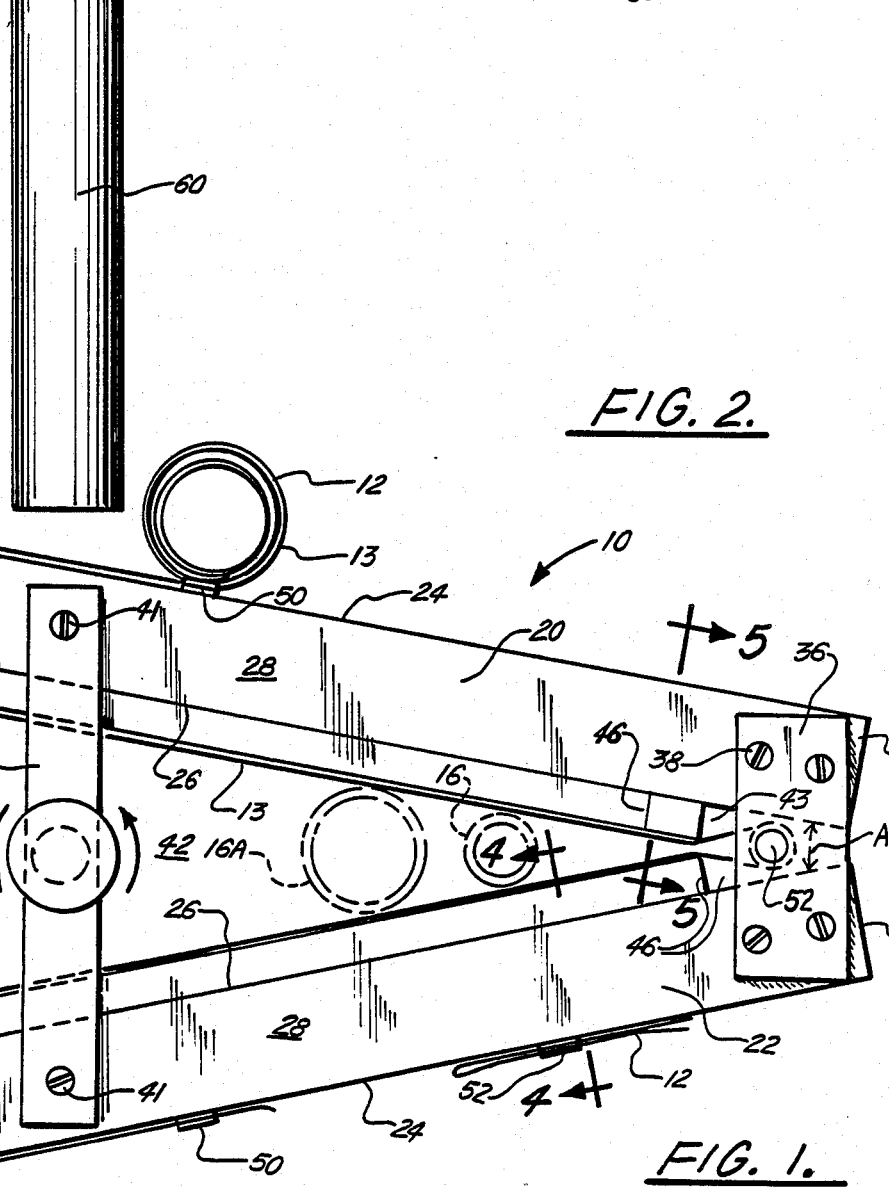
FIG. 2.
FIG. 1.

APPARATUS FOR FEEDING AND SECURING SANDING CLOTH WHEN SANDING TUBULAR OBJECTS

BACKGROUND OF THE INVENTION

1. Field of the Invention

The apparatus of the present invention relates to sanding cloth. More particularly, the apparatus of the present invention relates to an apparatus for securing and feeding a continuous sanding cloth within a pair of body support members, and for securing the cloth while the apparatus is manipulated to sand the exterior surface of a tubular member such as a length of copper pipe.

2. General Background

Prior to soldering or brazing a length of pipe, for example copper tubing, into a fitting, it is required that the surface of both the fitting and the pipe be cleaned of impurities so that the joint may be assembled correctly, without having to forego the expense and time of repairing a faulty joint.

At the present time, copper pipe or tubing undergo cleaning prior to the soldering or brazing through simply holding a piece of brasive cloth, such as a sanding cloth in ones hand, the pipe in the other hand, and rubbing the abrasive cloth over the surface of the pipe until the desired surface area of the pipe or tubing is cleaned. This method of cleaning is very time consuming, tedious, and fatigue causing. A second method is to utilize a vise in securing the copper tubing or pipe, and grasping both ends of a strip of abrasive sand cloth, and reciprocating the cloth over the surface of the pipe to clean the end of the pipe so that the pipe may be joined to a joint section. There may be also found in the present state of the art the use of what is called an inverted circular brush containing metal bristles wherein the pipe or tubing is inserted to make contact with the metal bristles. Thus by rotating the brush while maintaining the pipe stationary, the pipe is cleaned. The shortcoming of this particular method is the fact that the inside of the brush has a particular diameter, and therefore it is almost impossible to clean the various pipe diameters, and maintaining a number of brushes for the different pipe diameters would be expensive and impractical.

Several patents have been cited which relate to pipe cleaning, the most pertinent being as follows:

U.S. Pat. No. 2,922,218 issued to Lewis, entitled "Pipe Cleaning Device", there is provided a single piece tongs having the ends of the arms bend longitudinal along arch of a cylinder. There is a scored filed surface on the inner portion of the cylinder, so that as the ends of the tongs are bent sufficiently inwardly, the tool will be in contact over an extended arc with the surface of the pipe in the fitting to be cleaned.

U.S. Pat. No. 3,638,367 issued to Dreger, entitled "Abrasive Plumber's Tool", relates to a short length of an abrasive strap having an abrasive plug mounted at each end. Pre-cleaning with the strap is affected by wrapping the strap around the tube or pipe with a single turn and providing the strap with a few quick rotary movements relative to the tube or pipe. Each plug would be adapted to pre-clean the interior of a fitting or the like.

U.S. Pat. No. 3,975,868, issued to Botimer, entitled "Sanding Device", relates to a sanding block-paper arrangement in which opposite ends of the paper have been inwardly inserted in slots in the opposite ends of the block in which the force is applied to the paper during the sanding operation and maintains the paper firmly against the block.

U.S. Pat. No. 3,568,376, issued to Slater, entitled "Polisher For Pipe Ends", relates to a tool having a cylindrical body with a pipe guide means on one end. There may be included radially adjustable jaws, bushings or tongs which a roll of sand paper or other abrasive strip may be supported on the tool to form an abrasive element. One end of the strip is attached to the tool and the other end of the strip is held in tension with the pipe thus by rotating the tool the pipe can be cleaned.

U.S. Pat. No. 1,595,700, issued to Backlind, entitled "Abrading Tool", relates to a tool wherein a strip of sand paper or the like is formed around a curved section of the tool wherein the upper portion of the curve can be hand held and the bottom surface of the tool accommodates the length of sand paper for moving the tool to and fro in order to effect sanding.

U.S. Pat. No. 2,189,980, issued to Forsblade, entitled "Holder For Sandpaper And The Like", relates to an apparatus having a pair of spaced apart upper and lower sections, that are hingedly attached, to accommodate each section accommodating sand paper. There is inserted a wood block intermediate the free ends of the section so that as pressure is applied to the block in the free ends, the sand paper is engaged in position against the block and therefore sanding is accomplished.

SUMMARY OF THE PRESENT INVENTION

The apparatus of the present invention solves the short comings in the art in a simple and straight forward manner. What is provided is an apparatus for continuously feeding and securing an abrasive material such as sanding cloth; the apparatus including a pair of body portions secured on their first ends adjacent one another and secured on their second ends in a spaced-apart position for defining a V-shaped space therebetween. There is further included a cushioned layer secured to the inner face of each body portion forming the V containment space, so that a continuous length of sand cloth may be positioned within the V containment space set around a pin member inserted at the first ends of the body portion and each end of the sand cloth secured on the opposite face of each body portion during use. The apparatus further includes a handle member engaged to a bracket maintaining the second end portions in the spaced apart relation, so that when a section of pipe or the like is positioned against the surfaces of the sanding cloth, the apparatus may be rotated with the use of the handle member for abrading the surface of the section of pipe while the pipe is maintained stationary.

Therefore, it is a principal object of the present invention to provide an apparatus for abrading the section of pipe as the apparatus is rotated around the pipe;

It is a further object of the present invention to provide a tool for sanding the exterior surface of a tubular member by including a continuous length of sanding cloth on the apparatus for multiple applications in the sanding mode;

It is still a further object of the present invention to provide an apparatus for sanding the surface of the pipe by providing a cushion surface beneath the layer of sanding cloth to more thoroughly adhere to the surface height;

It is still a further object of the present invention to provide an apparatus for abrading pipe and eliminating the possibility of cut and sore fingers in the operation;

It is still a further object of the present invention to provide an apparatus for abrading the surface of a length of pipe so that a variety of pipe diameters can be cleaned without making adjustments to the apparatus; and It is still a further object of the present invention to provide an apparatus for abrading the surface of pipe eliminating any need for other tools to engage or position the pipe, and which can be utilized in a repeating fashion.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is an overall side view of the preferred embodiment of the apparatus of the present invention;

FIG. 2 is an under-side view of the preferred embodiment of the apparatus of the present invention;

DETAILED DESCRIPTION OF THE PREFERRED EMBODIMENT

Figure 3:
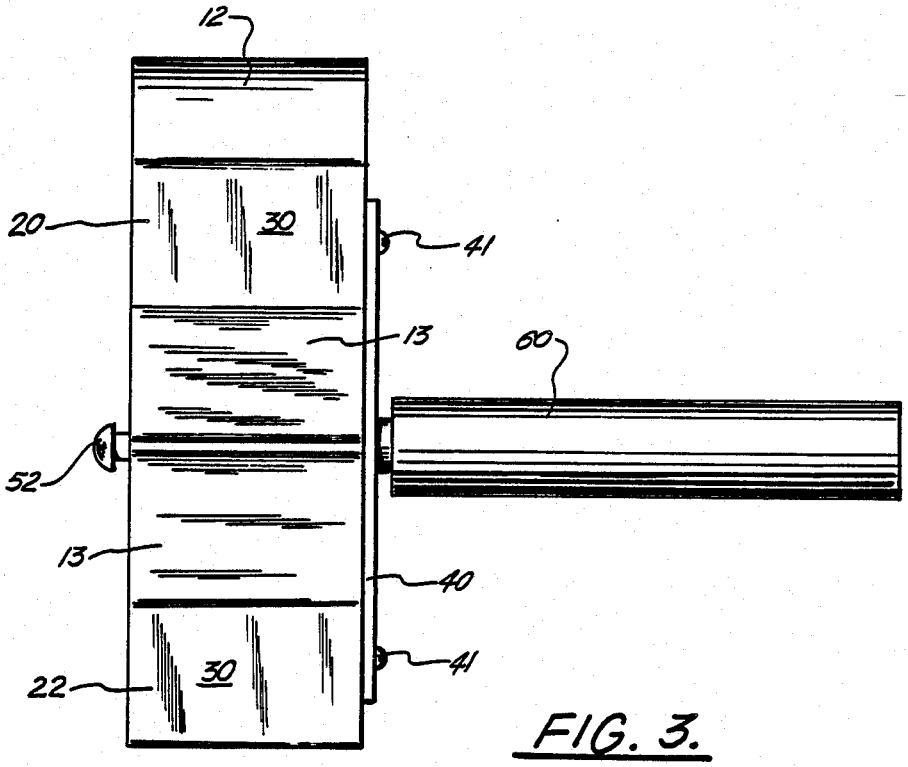
FIG. 3 is a frontal view of the preferred embodiment of the apparatus of the present invention.

The preferred embodiment of the apparatus of the present invention is illustrated by the numeral 10 in FIGS. 1–5. For purposes of explanation, apparatus 10 is to be utilized for mounting a continuous strip of sand cloth 12 within the apparatus so that the sand cloth can be effectively utilized to abrade the outer annular surface 14 of a length of pipe such as copper tubing 16 so that the copper tubing may be effectively jointed to a fitting for installation. Sand cloth 12 as it is known in the art, is simply a flexible material having an abrasive face 13 which serves to roughen the surface of a length of pipe 16 during use.

Turning now to the Figures, in FIG. 2 apparatus 10 is illustrated as having an upper body portion 20 and a lower body portion 22. Both the upper and lower body portions substantially comprising a rectangular shaped section of material such as wood, molded plastic or the like, each section of material including an outer surface 24, an inner surface 26, and a pair of side walls 28, a front end portion 30, and a rear end portion 32, all comprising the rectangular configuration of each body portion 20 and 22. As seen in the Figures, the rear end portion 32 of each body portion 20 and 22 are attached adjacent one another via bracket member 36 which is screwed into the side walls 28 of body portions 20 and 22 via a plurality of wood screws or the like 38.

As seen in FIG. 2, bracket 36 is rigidly attached to members 20 and 22 in such a manner to rigidly hold members 20 and 22 at their end portions 32 adjacent one another but extending outward at an angle indicated by A in FIG. 2, of approximately 22°.

Further, on their second end portions 30, there is included a second bracket member 40 which is secured at its end portions to the side wall 28 of body portions 20 and 22 via screws 41 maintaining the second end portions 30 a sufficient distance apart so that a section of copper tubing or the like 16 may be positioned within a containment space 42 intermediate the body portions 20 and 22 defined by the angle of spread between the two body portions.

Figure 4:
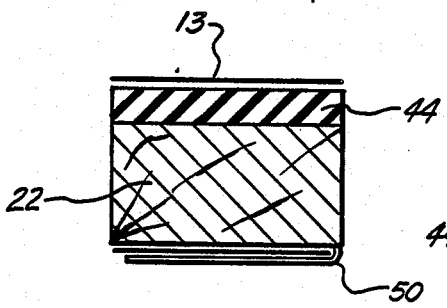
FIG. 4 is a cross-sectional view along lines 4—4 in FIG. 2 of the lower body member of the preferred embodiment of the apparatus of the present invention.
Figure 5:
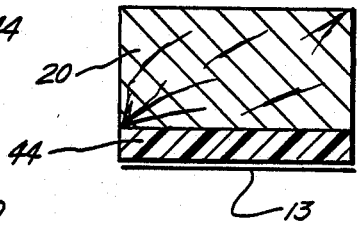
FIG. 5 is a cross-sectional view along lines 5—5 of FIG. 2 of the preferred embodiment of the apparatus of the present invention.

There is further included, as seen in FIGS. 2, 4 and 5, a length of soft foam 44 attached to the undersurface 26 of body portions 20 and 22, the foam 44 attached through gluing or the like and defining a compressible surface for accommodating a length of copper tubing as will be discussed further. Soft foam sections 44 terminate at their end points 46 adjacent end portions 32 of body portions 20 and 22, wherein there is further including a block of firmer foam, known in the industry as Ensolite HC foam, which is likewise glued to the under surface 26 of each body portion 20 and 22 and serves to firmly accommodate the positioning of the layer of sand cloth 12 within the apparatus.

Turning now to the means for securing the sand cloth 12 onto apparatus 10, reference is made to the roll of sand cloth 12 positioned onto the upper surface 24 of body portion 20 via a type of clip such as a belt clip 50 to secure the sand cloth thereupon. The sand cloth 13 extends along the upper surface 24 of body portion 20, the front face 30, and along the outer face of foam section 44 rearwardly towards the end 32 of body 20. At that point, sand cloth 13 encircles a pin member 52 which is threadably engaged (see FIG. 2), into bracket 36, and extends the width of apparatus 10 within the rear interior space 43 as defined by that space between the ends 32 of body portions 20, 22, and the firm foam members 46. Following the circling of pin 52, the continuous length of sand cloth proceeds along the inner face of foam layer 44 attached to body portion 22 along the front face of body portion 22 and along the lower face 24 of body portion 22 where it is held in position against via a clip member such as belt clip 50 for securely fastening it in place. For purposes of use, the abrasive side 13 of sand cloth 12 would be facing within space 42 for proper use.

Further, located on lower face 24 of body portion 22 there is included a second clip member 53 of the type similar to clip 50, but which is utilized to hold a separate piece of sand cloth which would be used in the event that a section of pipe was not in a position where the apparatus can be fixed around it, which is in a confined space, and therefore one would have to manually utilized the sand cloth in ones hand for the abrading process. As illustrated in FIG. 1, a second portion of sand cloth 12 is engaged within clip member 53.

Following the engagement of length of sand cloth 12 as seen in the Figure, reference is made to the means for holding apparatus 10 into position during use. This means comprises a handle member 60 extending outwardly from the face of bracket 40 and attached thereto via a rotary attachment, so that handle member 60 may rotate freely in the directions of Arrows 62 during use of the apparatus, as seen in FIGS. 2 and 3.

Therefore, during use a length of pipe such as copper tubing 16 as seen in FIG. 2, is placed within space 42 to a position whereby both upper and lower portions of outer surface 16 of pipe 14 engages the abrasive surface of sand cloth 12 as seen in FIG. 2. At that point, while holding the pipe along its length, the user would grasp handle member 60 and rotate the apparatus in the direction of Arrows 64 as seen in FIG. 2, until such time as one was assured that the outer surface of pipe 14 was abraded properly. As seen further in FIG. 2, there is illustrated a second larger pipe section 16A which is inserted within space 42, to illustrate the fact that various sizes of copper tubing can be abraded with the use of the apparatus without having to change the positions of body members 20 and 22 during use. As is apparent from FIG. 1, the section of pipe would always be entered into the apparatus along the side of the apparatus opposite the side that brackets 36 and 40 are mounted, in the direction of Arrow 70, so that the pipe would have access to the space 42 and so that the apparatus could be rotated fully by handle 60 without interference with the section of pipe engaged in the apparatus.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for feeding and securing sanding cloth when sanding stationary tubular members, the apparatus comprising;

a. a first upper body portion;

b. a second lower body portion;

c. means for securing together the upper body portion and the lower body portion at a first end substantially adjacent one another;

d. means for positioning and maintaining a second end of the upper body portion and lower body portion a fixed distance apart so that a space is defined between the body portions which provides for a continuous converging space between the first ends of the upper body portion and the lower body portion and the second end of the upper body portion and the lower body portion, for engaging various diameters of tubular members between the upper body portion and the lower body portion; therewithin; and e. a length of sanding cloth positioned intermediate and along the length of the body portions and a tubular member positioned in the converging space for abrading the surface of the tubular member as the tubular member makes contact with the sanding cloth on the upper body portion and the lower body portion, as the apparatus is rotated around the surface of the stationary tubular member.

2. The apparatus in claim 1, wherein there is further included a compressible layer of material on the inner faces of the upper body portion and the lower body portion for engaging the tubular member therebetween.

3. The apparatus in claim 1, wherein there is further included means on the upper and lower body portions for tightly engaging the length of sand cloth along the body portions during sanding.

4. The apparatus in claim 1, wherein the means for engaging the first end of the body portions adjacent one another further comprises a bracket member engaged to the wall of each body portion.

5. The apparatus in claim 1, wherein there is further included a handle member secured to the apparatus for rotating the apparatus around the stationary tubular member during sanding.

6. An apparatus for feeding and securing sanding cloth when sanding stationary tubular members, the apparatus comprising:

a. an upper body portion;

b. a lower body portion;

c. a first bracket means engaging a first end of the upper body portion to the lower body portion;

d. second bracket means maintaining a second end of the body portion a distance apart, so that there is defined a tubular member containment space between the first end of the body portions and the second end of the body portions;

e. a compressible layer secured to the inner face of the upper body portion and lower body portion, facing inwardly towards the containment space;

f. a length of sanding cloth securely mounted to the upper body portion and traveling along the inner faces of the upper body portion and lower body portion further secured to a pin member secured to the first bracket means as the sanding cloth extends from the upper inner face to the lower inner face define an abrasive surface upon which the stationary tubular member secured in the containment space makes contact; and g. handle means for rotating the apparatus around the surface of the tubular member while the member is held stationary within the containment space defined therein.

7. The apparatus in claim 6, wherein the handle means for rotating the apparatus around the stationary tubular means is secured to the second bracket member along its length.

8. The apparatus in claim 6, wherein there is further provided a portion of the compressible layer on the inner face of the body members as defining a substantially rigid portion for engaging sanding cloth thereupon.

9. The apparatus in claim 6, wherein the body portions may be constructed of plastic or woor.

10. An apparatus for sanding the surface of a stationary copper pipe, comprising:

a. a principal body portion, having an upper member and a lower member, the members positioned to form a V-shaped tubular containment space therebetween defined by their inner surfaces;

b. a length of sand cloth secured on upper and lower faces of the members defining the containment space.

c. means for securing the upper member and lower member substantially adjacent one another at a first end of the body portion;

d. means for maintaining at a second end of the body portion the upper member and lower member spaced apart to define the V-containment space; and e. handle means secured to a bracket member mounted to the body portion for rotating the apparatus around the length of copper pipe so that the sand cloth on the inner surfaces of the upper and lower body members abrades the surface of the copper pipe during rotation around the stationary pipe.

11. The apparatus in claim 10, wherein the body portions extend outwardly from one another to form an angle from approximately 22 degrees.

12. The apparatus in claim 10, wherein the containment area is able to accommodate various diameters of copper tubing between the inner surfaces of the body members during sanding.

* * * * *